US008550167B2

(12) United States Patent
Comeaux et al.

(10) Patent No.: US 8,550,167 B2
(45) Date of Patent: Oct. 8, 2013

(54) REMOTE OPERATED VEHICLE INTERFACE WITH OVERTORQUE PROTECTION

(75) Inventors: David D. Comeaux, Houston, TX (US); Erin E. Zimmermann, Jr., Houston, TX (US); Jose R. Menchaca, Jr., Houston, TX (US)

(73) Assignee: Vetco Gray Inc., Houston, TX (US)

( * ) Notice: Subject to any disclaimer, the term of this patent is extended or adjusted under 35 U.S.C. 154(b) by 184 days.

(21) Appl. No.: 13/052,683

(22) Filed: Mar. 21, 2011

(65) Prior Publication Data

US 2012/0241159 A1 Sep. 27, 2012

(51) Int. Cl.
*E21B 7/12* (2006.01)

(52) U.S. Cl.
USPC ..... 166/338; 166/339; 166/360; 166/364; 166/368; 166/85.1

(58) Field of Classification Search
USPC ..... 166/338, 339, 360, 364, 368, 85.1; 285/1, 2; 137/67, 68.15, 68.16
See application file for complete search history.

(56) References Cited

U.S. PATENT DOCUMENTS

| | | | | |
|---|---|---|---|---|
| 3,211,223 | A * | 10/1965 | Hoch | 166/356 |
| 3,732,923 | A * | 5/1973 | Fowler | 166/340 |
| 5,002,129 | A * | 3/1991 | Hopper | 166/338 |
| 6,041,804 | A * | 3/2000 | Chatufale | 137/15.23 |
| 6,231,027 | B1 * | 5/2001 | Baker et al. | 251/58 |
| 6,572,076 | B1 * | 6/2003 | Appleford et al. | 251/69 |
| 6,585,227 | B2 * | 7/2003 | Newport et al. | 251/58 |
| 6,609,532 | B1 * | 8/2003 | Peterson | 137/15.18 |
| 6,609,533 | B2 * | 8/2003 | Sundararajan | 137/15.19 |
| 6,659,133 | B2 * | 12/2003 | Russell | 138/94 |
| 7,108,006 | B2 | 9/2006 | Armstrong | |
| 7,398,764 | B2 * | 7/2008 | Koehler et al. | 123/458 |
| 7,523,916 | B2 | 4/2009 | Fenton | |
| 7,641,487 | B2 * | 1/2010 | Morgan | 439/158 |

(Continued)

FOREIGN PATENT DOCUMENTS

| | | | |
|---|---|---|---|
| GB | 2390654 | A | 1/2004 |
| GB | 2408299 | A | 5/2005 |
| GB | 2473444 | A | 3/2011 |
| WO | 2010141795 | A2 | 12/2010 |

OTHER PUBLICATIONS

GB Search Report dated Jul. 16, 2012 from corresponding Application No. GB1204656.1.

(Continued)

*Primary Examiner* — Matthew Buck
*Assistant Examiner* — Aaron Lembo
(74) *Attorney, Agent, or Firm* — Bracewell & Giuliani LLP

(57) ABSTRACT

A remote operated vehicle (ROV) interface has a retrievable portion and a permanent portion. The permanent portion includes a housing that has a cavity that secures to a drive stem of the subsea well device. The housing has a pod cavity on an opposite end that receives a pod body, which is part of the retrievable portion. The pod body is secured by spring-biased retainer within the pod cavity. The pod body has a cylindrical receptacle that receives a drive pin, which forms another part of the retrievable portion. The drive pin and the cylindrical receptacle are engaged for rotation by a shear element. The pod body has an ROV retrieval profile that is accessible by an ROV. In the event the shear element shears due to excessive torque, an ROV retrieval tool engages the pod body and retrieves the pod body along with the drive pin.

20 Claims, 4 Drawing Sheets

(56) References Cited

U.S. PATENT DOCUMENTS

| | | | | |
|---|---|---|---|---|
| 8,011,434 | B2 * | 9/2011 | Cosgrove et al. | 166/341 |
| 8,281,863 | B2 * | 10/2012 | Voss | 166/351 |
| 2001/0011592 | A1 * | 8/2001 | Baker | 166/339 |
| 2003/0020034 | A1 * | 1/2003 | Newport et al. | 251/58 |
| 2003/0098151 | A1 * | 5/2003 | Cove et al. | 166/86.1 |
| 2005/0051336 | A1 * | 3/2005 | Bartlett | 166/344 |
| 2005/0081916 | A1 | 4/2005 | Williams et al. | |
| 2008/0264646 | A1 * | 10/2008 | Sten-Halvorsen et al. | 166/360 |
| 2011/0056696 | A1 * | 3/2011 | Bamford | 166/363 |
| 2012/0048565 | A1 * | 3/2012 | Udipi et al. | 166/335 |
| 2012/0186039 | A1 * | 7/2012 | Long | 16/2.1 |
| 2012/0234410 | A1 * | 9/2012 | Borchgrevink et al. | 137/556 |

OTHER PUBLICATIONS

GB Search Report dated Sep. 27, 2012 from corresponding Application No. GB1204656.1.

* cited by examiner

REMOTE OPERATED VEHICLE INTERFACE WITH OVERTORQUE PROTECTION

FIELD

This disclosure relates in general to an interface for receiving a drive tool of a remote operated vehicle for rotating subsea equipment, such as subsea valve actuators, and particularly to an interface having an overtorque protection device.

BACKGROUND

Subsea well equipment, such as subsea trees, employs valves that are typically hydraulically or electrically actuated. The valve actuators normally have an overriding mechanism that allows the valve to be opened or closed manually, rather than hydraulically or electrically. The manual actuation occurs in response to rotation of a drive stem or shaft by an external device, such as a remote operated vehicle (ROV). Subsea well equipment may have other shafts that are rotated by an ROV. An ROV is deployed on an umbilical from a surface vessel and controlled from the surface vessel.

Valve actuators have components in their drive train that may fail or be damaged if the torque imposed by the ROV is excessive. Typically, an operator will calibrate the ROV while at the vessel so that it will not impose a torque greater than the maximum capability of the device that it is to rotate. On occasion, personnel may err and set the torque limit for the ROV too high. If that occurs, a possibility exists that the drive train of the subsea device will be damaged. Retrieving the subsea device for repair can be difficult and expensive.

SUMMARY

An interface device coupled to a shaft of the subsea well device is adapted to receive an ROV drive tool to rotate the interface device and shaft of the well device. The interface device has two components: a permanent module and a retrievable module. The permanent module is coupled to the shaft of the well device to transmit rotation of the permanent module to the shaft. This permanent portion of the ROV interface is mounted so as to remain subsea for an extended period of time. The ROV interface has a retrievable module with drive and driven members that are coupled together for rotation in unison by a shear element. The driven member is releasably coupled to the permanent module for transmitting rotation of the driven member to the permanent module. The drive member of the retrievable module is engageable with a drive tool of the ROV to cause the drive member, the driven member and the permanent module to rotate the subsea well device shaft. The retrievable module also has an ROV retrieval profile to retrieve the retrievable module in the event the shear element shears. The retrieval profile is configured to be engaged by retrieving tool of the ROV. The drive and driven members are retrievable together by the ROV while the permanent module remains attached to the shaft.

In the preferred embodiment, the drive and driven members have cylindrical surfaces that mate with each other. A recess in one of the cylindrical surfaces mates with a recess in the other of the cylindrical surfaces to define a shear element cavity. A shear element locates within this shear element cavity. A spring biased retainer releaseably retains the driven member in engagement with the permanent module. The retainer will release upon a straight pull by the ROV that is sufficient to overcome the force of the spring-biased retainer.

Preferably, the retrieval profile for the ROV is located on the driven member. It may comprise a pair of slots located in a forward end of the driven member. Each of the slots may have an entry portion with an open end sized to receive a retrieval tool of the ROV. Each of the slots has a retainer portion that prevents removal of the retrieval tool once it is rotated from the entry portion into the retainer portion of the slot. Preferably, the driven and drive members are secured together by retainer mechanism that prevents them from being separated after shearing and retrieval.

In the embodiment shown, the permanent module comprises a housing with forward and rearward ends. A drive cavity extends into the housing from the rearward end for coupling to the well device shaft. A pod cavity extends into the housing from the forward end. The retrievable module includes a pod body that is located in the pod cavity for rotation with the housing. The pod body has a cylindrical receptacle that extends into the pod body from the forward end of the pod body. A spring-biased retainer releaseably retains the pod body in the pod cavity.

The retrievable module also includes a drive pin, which is the drive member. The drive pin has a cylindrical base that locates within the receptacle of the pod body. The drive pin has a protruding polygonal portion for engagement by a drive member of the ROV.

The shear element may be located between the base of the drive pin and the receptacle. The shear element applies to the pod body torque imposed by the ROV on the drive pin to cause rotation at the housing and the drive shaft. The shear element shears in the event the ROV applies excessive torque.

In the embodiment shown, the housing cavity that receives the pod body is not cylindrical. In the embodiment shown, the housing cavity is elongated, having a major axis dimension and a minor axis dimension. The major axis dimension is greater than the minor axis dimension. The portion of the pod body that locates within the cavity of the housing has a mating configuration for alignment and torque transfer. In one embodiment, the elongated sides of the housing cavity are flat and parallel with each other. The spring-biased retainer in that instance may comprise two detent members, each protruding into the cavity and engaging depressions formed on the flat sides of the pod body. A detent member is biased by coil spring into engagement with one of the depressions.

DETAILED DESCRIPTION

Figure 1:
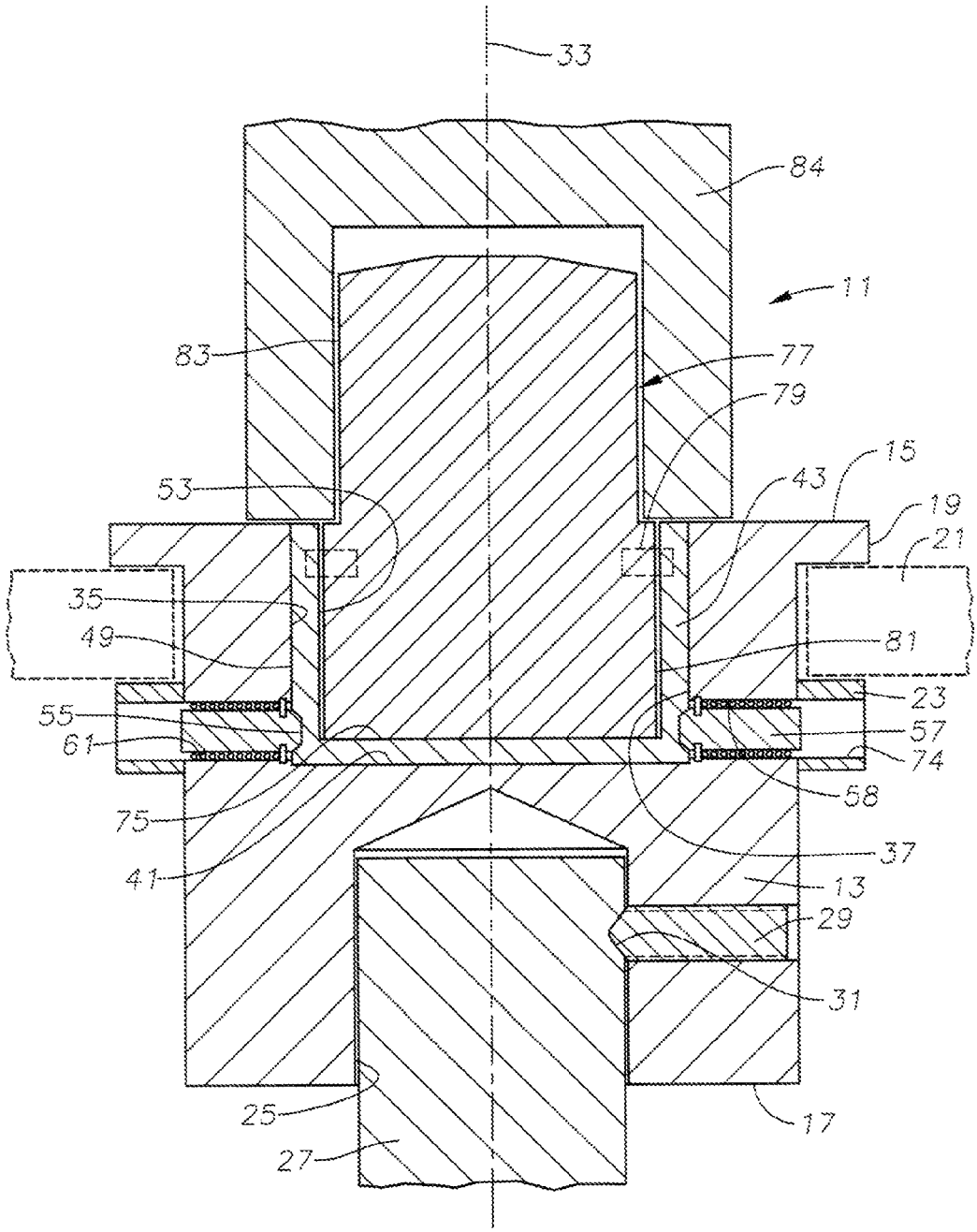
FIG. 1 is a sectional view illustrating an ROV interface constructed in accordance with this disclosure.

Referring to FIG. 1, a remote operated vehicle (ROV) interface 11 has a permanent module that includes a housing 13. Housing 13 has a forward end 15 and a rearward end 17. The terms "forward" and "rearward" are arbitrary; the forward end 15 is positioned to be more accessible to an ROV than the rearward end 17. Housing 13 may have an external cylindrical flange 19 extending outward from forward end 15. Housing 13 is generally cylindrical in this embodiment and mounts to a subsea well device, such as a subsea well device panel 21. Housing 13 is rotatable relative to at least portions of panel 21. Although shown facing upward, forward end 15 could be oriented horizontally or other directions.

A filler ring 23 may be secured to the outer diameter of housing 13 and in abutment with subsea panel 21. Part of panel 21 fits between flange 19 and filler ring 23. Other ways to mount housing 13 to a subsea well device are feasible. Housing 13 is considered to be part of a permanent module in that once mounted to subsea panel 21, it is intended to remain there for an indefinite period, which could be years.

Housing 13 has a drive cavity 25 that extends from housing rearward end 17 in a forward direction. Drive cavity 25 is illustrated to be a cylindrical closed bottom hole, but it could have different configurations. A cylindrical drive stem or shaft 27 is mounted within drive cavity 25 for rotation with housing 13. Drive shaft 27 is a part of a subsea well device, such as a rotatable drive stem of a subsea valve actuator. In this example, the end portion of drive shaft 27 has a smooth cylindrical exterior surface and is secured by an antirotation device so that rotation of housing 13 causes rotation of drive shaft 27. The antirotation device could be many different types. As an example, it is shown to be a set screw 29 extending through a threaded hole in housing 13. Set screw 29 has an inner end that engages a conical recess or depression 31 formed in drive shaft 27. A pin extending completely through drive shaft 27 and secured by cotter pins at both ends is another type of antirotation device. A key or splines between drive shaft 27 and cavity 25 would also be feasible. Drive shaft 27 and drive cavity 25 extend along an axis 33 of rotation of ROV interface 11.

Figure 4:
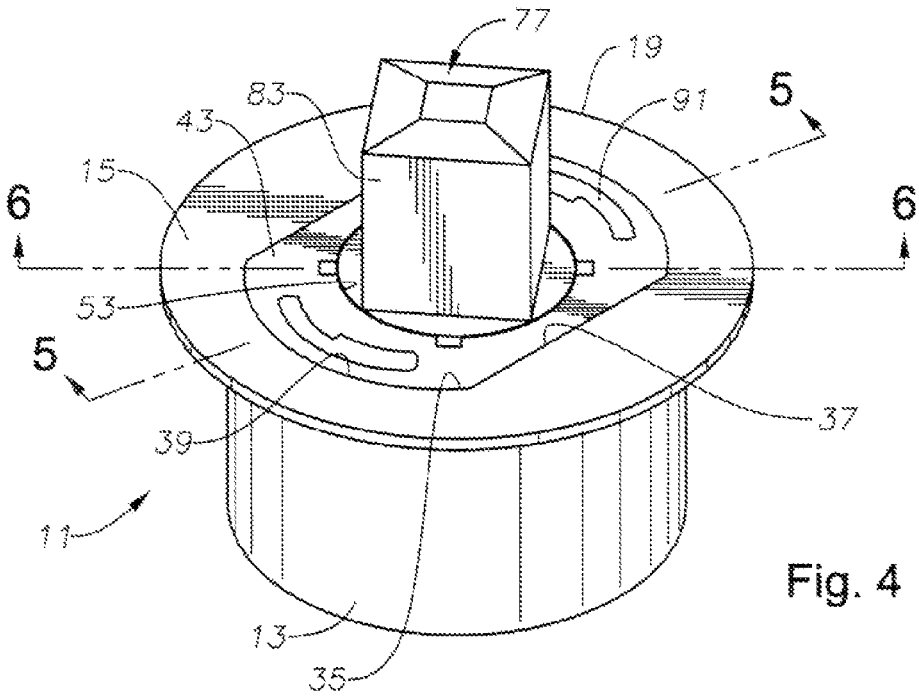
FIG. 4 is a perspective view illustrating the drive pin mounted in the pod body, and the pod body mounted in the housing of the interface of FIG. 1.

A pod cavity 35 is formed in housing 13, also along axis 33. Pod cavity 35 extends from forward end 15 into housing 13. In this example, pod cavity 35 does not intersect drive cavity 25, rather it is spaced a short distance in a forward direction from the base of drive cavity 25. Referring to FIG. 4, pod cavity 35 may be other than cylindrical. It is shown to have two parallel flat sides 37 joined by two curved ends 39. Other configurations are feasible. Curved ends 39 are farther from each other than flat sides 37 in this embodiment. Referring back to FIG. 1, pod cavity has a flat bottom 41 in this embodiment, but it could be other than flat.

A pod body 43, which forms part of a retrievable module, has a mating contour to and fits within pod cavity 35. The forward end of pod body 43 may be flush with forward end 15 of housing 13. Pod body 43 is illustrated in more detail in FIG. 3. It has an elongated configuration, with a major axis 45 and a minor axis 47. Major axis 45 is perpendicular to minor axis 47, and both are illustrated in a plane that is perpendicular to the axis of rotation 33 (FIG. 1). Pod body 43 has two flat sides 49 that are parallel to each other. It has rounded ends 51 that join flat sides 49. Pod body 43 has a cylindrical receptacle 53 that extends into pod body 43 from its forward end. Pod body 43 also has retainer depressions 55 on opposite flat sides 49.

Figure 7:
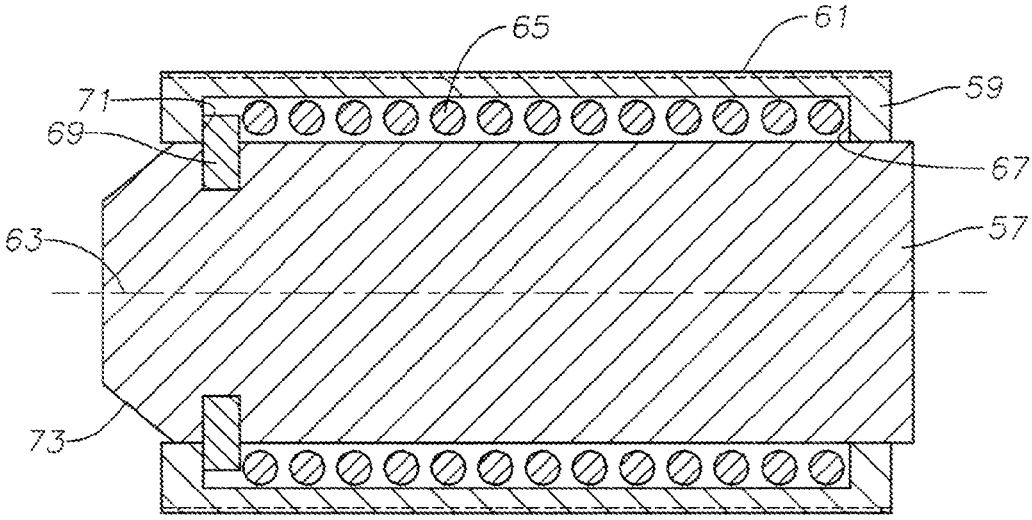
FIG. 7 is an enlarged view illustrating one of the spring-biased retainers of the interface device of FIG. 1.

Referring to FIGS. 1 and 7, spring-biased detents 57 are shown for engaging depressions 55. Each detent 57 is carried within a threaded hole 58 that extends through a portion of housing 13. When engaged with depressions 55, detents 57 prevent pod body 43 from releasing or being removed from pod cavity 35 unless a sufficient pull in a forward direction is applied to overcome the forces exerted by detents 57.

The assembly for each detent 57 includes a sleeve 59 with external threads 61 that engage threaded hole 58. Each detent 57 comprises a cylindrical pin that is carried within sleeve 59 for movement in inner and outer directions along a detent axis 63. Shapes other than cylindrical are feasible. A coil spring 65 encircles detent 57 for urging detent 57 in an inward direction. Coil spring 65 has an outer end that abuts an internal shoulder 67 on an outer end of sleeve 59. Coil spring 65 has an inner end that abuts a split ring or shoulder 69 mounted around detent 57 near its inner end. An internal shoulder 71 extending internally from sleeve 59 near its inner end is abutted by split ring 69 to provide a stop to movement of detent 57 in the inward direction. Detent 57 has a bevel 73 on its inner end that mates with a similar configuration for depression 55 (FIG. 1). Bevel 73 may be conical. Also, as shown in FIG. 1, filler ring 23 may have a hole 74 adjacent each detent 57. Hole 74 receives the outer end of detent 57 when detent 57 moves outward relative to axis 33.

Referring still to FIG. 1, pod body 43 may have a bottom 75, the lower surface of which abuts pod cavity bottom 41. Another portion of the retrievable module comprises a drive pin 77, which has a cylindrical base 81 closely received within cylindrical receptacle 53. Drive pin 77 is secured within receptacle 53 by a retaining ring or device 79. Retaining device 79 is shown schematically with dotted lines. It could comprise a split ring, a threaded ring, or some other device. Retaining device 79 retains drive pin 77 with pod body 43 at all times while subsea. Drive pin 77 and pod body 43 may be considered to be a retrievable module or portion of ROV interface 11 because it is readily retrieved while the permanent portion comprising housing 13 remains subsea. Drive pin 77 may be considered to be a drive member and pod body 43 a driven member, each having cylindrical surfaces 53, 81 that mate with one another.

Figure 2:
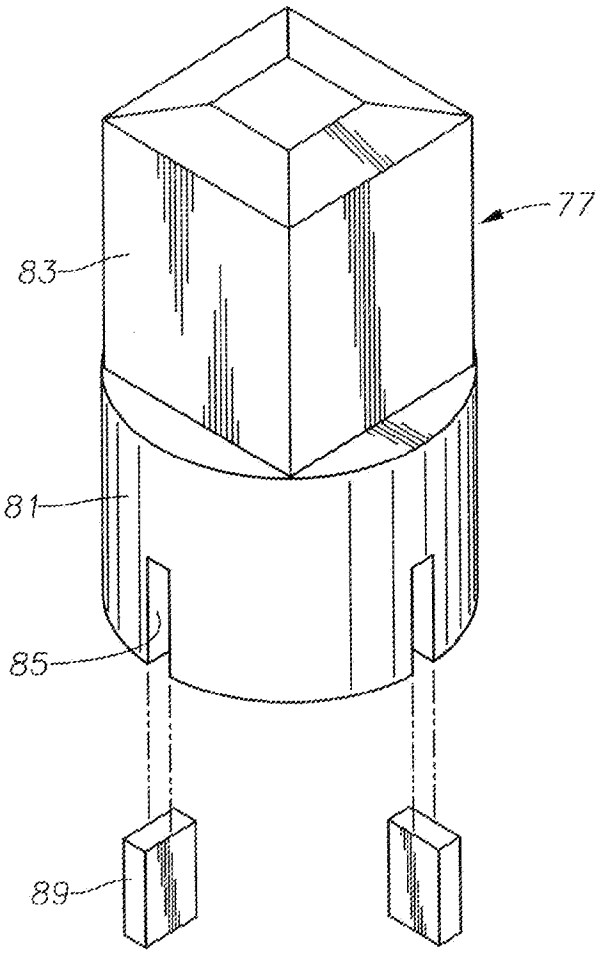
FIG. 2 is a perspective view of the drive pin of the interface of FIG. 1.

As shown in FIG. 2, drive pin 77 has a polygonal portion 83 that extends in a forward direction from its base 81. Polygonal portion 83 is shown as having flat external drive surfaces for being engaged by an ROV drive tool 84 (FIG. 1). This example illustrates four drive surfaces, but there could be a different number and the drive surfaces could be other than flat. In this example, drive tool 84 is a sleeve or socket that slides over polygonal portion 83. However, this arrangement could be reversed with polygonal portion 83 being a sleeve that slides over a pin drive member of the ROV.

Figure 3:
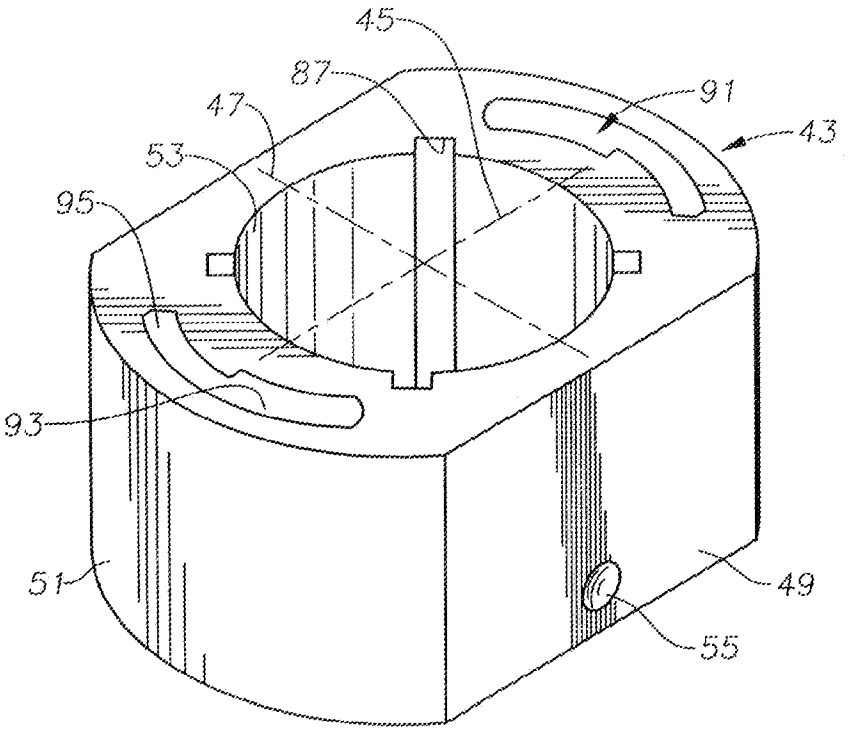
FIG. 3 is a perspective view of the pod body and shear tabs of the interface of FIG. 1.
Figure 6:
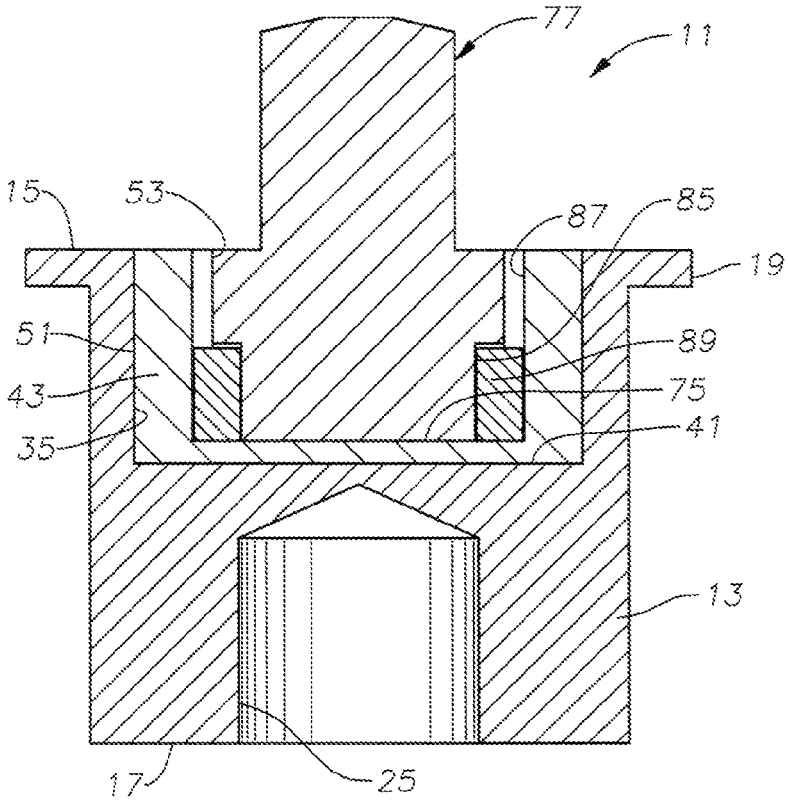
FIG. 6 is a sectional view illustrating the interface of FIG. 1, taken along 6-6 of FIG. 4 and with the filler ring and shaft removed.

Referring still to FIG. 2, base 81 has at least one shear element slot 85, and in this embodiment four are employed. Each shear element slot 85 is formed in the cylindrical surface of base 81 and extends axially a selected distance. As shown in FIGS. 3 and 6, shear element slots 85 align and mate with shear element slots 87 in cylindrical receptacle 53. As shown in FIG. 3, four slots 87 are illustrated, each about 90 degrees apart. The number could vary. Slots 87 mate with slots 85 (FIG. 2) to form rectangular cavities for receiving shear elements 89. Approximately one-half of each shear element 89 located within one of the slots 85, and the other half locates within one of the slots 87. Each shear element 89 is formed of a material and has a size that will cause it to shear if a selected torque between drive pin 77 and pod body 43 is exceeded. The torque selected will be lower than the torque that would damage the well device.

Shear elements 89 are shown to be rectangular, but they may have other shapes, such as cylindrical. Each cavity defined by slots 85, 87 has an entrance on the rearward end of drive pin base 81. In this example, receptacle slots 87 extend from receptacle bottom 75 to the forward end of pod body 43. Drive pin slots 85 extend from the rearward end of drive pin 77 part of the length of drive pin base 81.

To assemble drive pin 77 with pod body 43, shear elements 89 are inserted into slots 85 from the rearward end of drive pin 77, then drive pin 77 is inserted into receptacle 53 as shear elements 89 slide into slots 87. Then retaining ring 79 (FIG. 1) is secured.

Referring again to FIG. 3, pod body 43 has a retrieval profile 91 on its forward side for engagement with an ROV to pull pod body 43 from housing 13 (FIG. 1). The retrieval profile 91 may vary and comprises a structure that will receive and latch to a retrieval tool of an ROV, allow a force to be exerted on pod body 43 in a forward direction along axis 33 (FIG. 1). In this embodiment, retrieval profile 91 comprises two slots spaced approximately 180 degrees apart from each other relative to axis 33 (FIG. 1). Each retrieval profile 91 is located between one of the curved ends 51 and receptacle 53 of pod body 43. Each retrieval profile 91 is curved and comprises an entry portion 93 and a retainer portion 95. Entry portion 93 has a slot opening width that is larger than the opening width of retainer portion 95.

Figure 5:
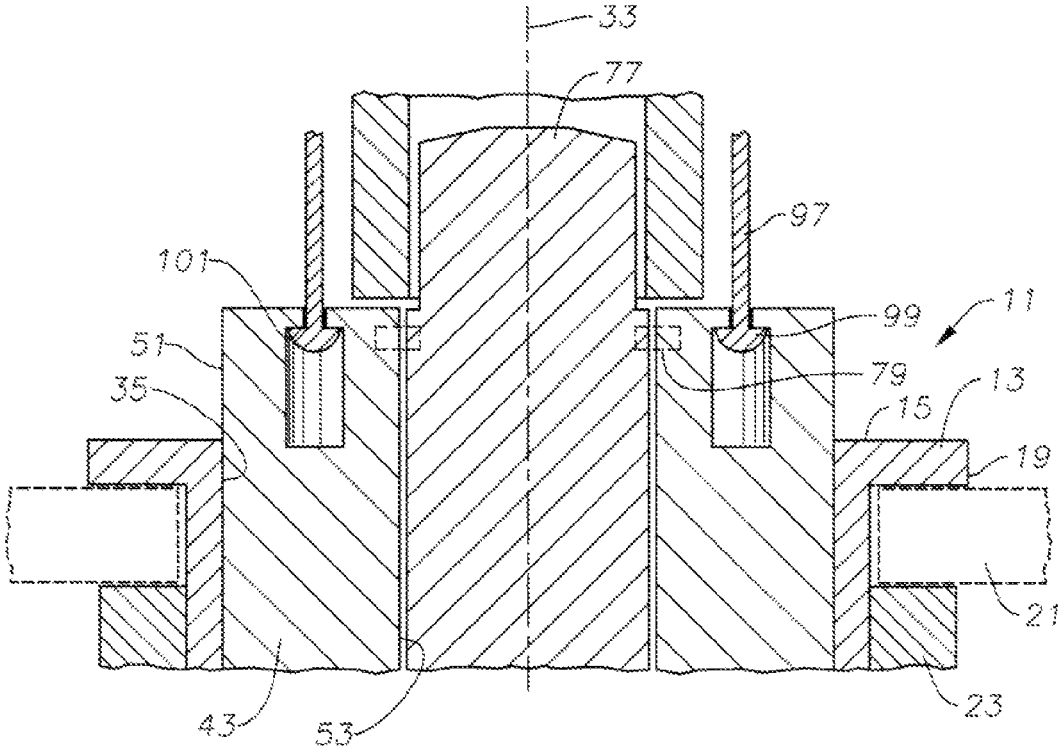
FIG. 5 is a enlarged sectional view of the interface of FIG. 1, taken along 5-5 of FIG. 4, and illustrating a retrieval tool of an ROV pulling the retrievable module from the permanent module.

As illustrated in FIG. 5, an ROV retrieval tool 97 may comprise two retrieval tool members, each having a shank with a head 99 on its free end. Head 99 is dimensioned to insert into slot entry portion 93 (FIG. 3). Rotating retrieving tool members 97 circumferentially about axis 33 a short distance causes heads 99 to slide from entry portion 93 into retainer portion 95. Retainer portion 95 has a smaller opening as mentioned, defining two ledges 101 facing in a rearward direction. Head 99 engages ledges 101 to allow the ROV to exert a force in a forward direction against pod body 43. The shank portion of each tool member 97 extends through the narrower opening of retainer portion 95.

In operation, the ROV interface 11 will be installed as illustrated in FIG. 1. Housing 13 will be secured to subsea well device shaft 27. Drive pin 77 will be secured within pod body 43, and pod body 43 will be secured within pod cavity 35 of housing 13. To cause shaft 27 to rotate, an ROV is lowered next to interface 11, and ROV drive tool 84 slides over drive pin 77. The operator at the surface vessel causes ROV drive tool 84 to rotate, which in turn causes drive pin 77, pod body 43, housing 13 and shaft 27 to rotate.

In the event excessive torque is applied by ROV drive tool 84, shear elements 89 (FIG. 6) will shear. After shearing, rotation imposed by ROV drive tool 84 will only rotate drive pin 77, and not pod body 43 and housing 13. The operator at the surface vessel will note a decrease in torque and/or more rapid rotation that occurs as a result of the shearing of shear elements 89. The operator will then set about replacing the components joined by shear elements 89. Because the ROV will have been calibrated wrong, the operator will preferably retrieve the ROV to recalibrate. Optionally, the ROV may have a retrieval tool 97 to retrieve the sheared retrievable module at the same time the ROV is being brought to the vessel for re-calibration. Otherwise, the operator will run the ROV back after calibration with a retrieval tool 97.

To begin the retrieval of the retrievable module, retrieval tool members 97 are pushed into retrieval slots 91. The operator causes a short amount of rotation of the two members of retrieving tool 97, which will place heads 99 below ledges 101, as shown in FIG. 5. The operator then applies a force on retrieving tool 97 in a forward direction and in an amount sufficient to cause detents 57 (FIG. 1) to snap out of engagement with depressions 55. The releasing of spring-biased detents 57 allows pod body 43 and drive pin 77 to be withdrawn from pod cavity 35, as illustrated in FIG. 5. If after being re-calibrated, the ROV carries an assembled replacement drive pin 77 and pod body 43, the ROV will reverse the retrieval procedure. The ROV will use retrieval tool 97 to push pod body 43 into pod cavity 35 until spring detents 57 snap back into depressions 55. Once detents 97 engage depressions 55, the operator rotates retrieval tool 97 in a reverse direction a short distance and removes retrieval tool 97 from retrieval profiles 91. The re-calibrated ROV may alternately retrieve the sheared retrievable module, allowing an operator to replace the shear elements 89 and re-run the repaired assembly When retrieving the sheared retrievable module, the sheared portions of shear elements 89 will also be contained within the retrievable module as these portions will remain within shear element slots 85 and 87. To repair the retrievable module at the surface vessel, the operator removes retaining ring 79 and pulls drive pin 77 from receptacle 53. The operator replaces shear elements 89 and reassembles drive pin 77 with drive pod 43.

Configuring the interface into a retrievable and permanent portion allows a readily accessible portion of interface 11 to be retrieved. This retrievable module comprises only the portion of interface 11 that needs repairing or replacing, making it unnecessary for retrieval of any of the portions that would normally remain permanently connected with the subsea well device.

Although the disclosure has shown only one of its forms, it should be apparent to those skilled in the art that it is not so limited but is susceptible to various changes and modifications.

The invention claimed is:

1. A remote operated vehicle (ROV) interface for transferring torque from an ROV to a shaft of a subsea well device, comprising:

a permanent module adapted to be coupled to the shaft of the well device to transmit rotation of the permanent module to the shaft;

retrievable module having drive and driven members coupled together by a shear element for rotation in unison, the driven member being releasably coupled to the permanent module for transmitting rotation of the driven member to the permanent module;

the drive member of the retrievable module having a polygonal portion engageable with a drive tool of the ROV to cause the drive member, the driven member, and the permanent module to rotate in unison to drive the shaft;

an ROV retrieval profile on the retrievable module for engagement by a retrieving tool of the ROV; and wherein the drive and driven members are retrievable together by the ROV while the permanent module remains attached to the shaft.

2. The interface according to claim 1, wherein:

the drive and driven members have concentric cylindrical surfaces that mate with each other;

a recess in one of the cylindrical surfaces mates with a recess in the other of the cylindrical surfaces to define a shear element cavity; and the shear element is located in the shear element cavity.

3. The interface according to claim 1 further comprising:

a spring-biased retainer releasably retaining the driven member in engagement with the permanent module, allowing retrieval of the retrievable module from the permanent module by a straight pull with the ROV to overcome a force of the spring-biased retainer.

4. The interface according to claim 1, wherein the ROV retrieval profile is located on the driven member.

5. The interface according to claim 1, wherein the retrieval profile comprises:

at least two sits in a forward end of the driven member;

each of the slots having an entry portion with an opening sized to receive the retrieval tool of the ROV; and each of the slots having a retainer portion that prevents removal of the retrieval tool, the retainer portion being accessible by the retrieval tool from the entry portion by rotating the retrieval tool.

6. The interface according to claim 1, further comprising:

a retainer mechanism that retains the drive and driven members together during retrieval.

7. An ROV interface for transferring torque from a remote operated vehicle (ROV) to a subsea well device, comprising:

a housing adapted to be mounted to the subsea well device, the housing having a forward end and a rearward end intersected by a housing axis;

a drive cavity for receiving a rotatable shaft of the subsea well device, the drive cavity extending axially into the housing front the rearward end and adapted to transmit rotation of the housing to the shaft;

a pod cavity extending axially into the housing from the forward end of the housing;

a pod body located in the pod cavity for rotation with the housing, the pod body having a cylindrical receptacle extending into the pod body from a forward end of the pod body;

a spring-biased retainer releasably retaining the pod body in the pod cavity;

a drive pin having a cylindrical base located within the receptacle of the pod body, the drive pin having a protruding polygonal portion for engagement by a drive member of the ROV;

a shear element located between the base of the drive pin and the receptacle, the shear element applying to the pod body torque imposed by the ROV on the drive pin to cause rotation of the housing and the drive shaft, the shear element being shearable in the event the ROV applies excessive torque; and an ROV retrieval profile accessible from is forward side of the pod body and allowing retrieval of the pod body and the pin from the housing by a straight pull with the ROV in a forward direction with sufficient force to overcome a force exerted by the spring-biased retainer.

8. The interface according to claim 7, wherein:

the housing cavity has a major axis dimension and a minor axis dimension that are perpendicular to each other and measured in a plane perpendicular to the housing axis, the major axis dimension being greater than the minor axis dimension; and the portion of the pod body that locates within the housing cavity has a mating configuration.

9. The interface according to claim 7, wherein the housing cavity has two sides that are flat and parallel with each other.

10. The interface according to claim 7, wherein:

the portion of the pod body that locates within the housing cavity has two flat sides that are parallel with each other;

the spring-biased retainer comprises a detent member protruding into the housing cavity; and a depression is formed in at least one of the flat sides of the pod body for engagement by the detent member.

11. The interface according to claim 7, wherein:

the spring-biased retainer comprises a detent member protruding into the housing cavity; and a depression is located in an exterior portion of the pod body for engagement by the detent member.

12. The interface according to claim 7, further comprising:

an axially extending slot in a sidewall of the base of the pin that mates with an axially extending slot in the cylindrical receptacle, defining, a shear element cavity; and wherein the shear element is located within the shear element cavity.

13. The interface according to claim 7, wherein the retrieval profile comprises:

at least two slots in a forward end of the pod spaced circumferentially from each other about the receptacle;

each of the slots having an entry portion with an opening sized to receive a retrieval tool of the ROV; and each of the slots having a retainer portion that prevents removal of the retrieval tool, the retainer portion being accessible by the retrieval tool from the entry portion by rotating the retrieval tool.

14. The interface according to claim 13, wherein the retainer portion of each of the slots extends in a circumferential direction from the entry portion relative to the cylindrical receptacle.

15. The interface according to claim 14, wherein:

the retainer portion of each of the slots has an opening leading to an enlarged portion, defining a rearward facing ledge for engagement by to forward facing shoulder of the retrieval tool.

16. The interface according to claim 7, further comprising:

a retaining ring in the receptacle of the pod body and in engagement with the base of the drive pin to retain the base of the drive pin in the receptacle.

17. A method of rotating a shall of a subsea well device, comprising:

providing a remote operated vehicle (ROV) interface with a permanent portion and a retrievable portion, the retrievable portion having drive and driven members coupled together for rotation in unison by a shear element, the driven member being releasably coupled to the permanent portion;

mounting the permanent portion of the interface to the shaft of the well device;

the drive member of the retrievable portion with a drive tool of the ROV and rotating the drive tool, causing the drive member, the driven member, and the permanent portion to rotate the shaft;

if torque imposed by the ROV exceeds a selected level, shearing the shear element, thereby stopping rotation of the shaft; then with a retrieving tool of the ROV, removing and retrieving the retrievable portion while leaving the permanent portion of the interface attached to the shaft.

18. The method according to claim 17, further comprising:

after retrieving the retrievable portion, replacing the shear element; then lowering the retrievable portion with the ROV and recoupling the driven member with the permanent portion.

19. The method according to claim 17, wherein removing the retrievable portion comprises engaging the retrieving tool with the drive member, then pulling in a straight direction with the retrieving tool.

20. The method according to claim 17, wherein:

the driven member is releasably coupled to the permanent portion by a spring detent member; and removing the retrievable portion from the permanent portion comprises overcoming a retaining force exerted by the spring detent member.

* * * * *